United States Patent [19]

Kurata

[11] 3,965,302

[45] June 22, 1976

[54] STEREO SIGNAL DEMODULATOR IN A FOUR-CHANNEL STEREO BROADCAST RECEIVER

[75] Inventor: Hirotaka Kurata, Tokyo, Japan

[73] Assignee: Sansui Electric Co., Ltd., Tokyo, Japan

[22] Filed: Jan. 28, 1975

[21] Appl. No.: 544,903

[30] Foreign Application Priority Data

Jan. 31, 1974 Japan ..... 49-13436

[52] U.S. Cl. ..... 179/15 BT

[51] Int. Cl.[2] ..... H04H 5/00

[58] Field of Search .... 179/15 BT, 1 GQ, 100.4 ST, 179/100.1 TD; 325/36, 50

[56] References Cited

UNITED STATES PATENTS

| | | | |
|---|---|---|---|
| 3,754,099 | 8/1973 | Takaoka | 179/15 BT |
| 3,814,858 | 6/1974 | Parker | 179/15 BT |
| 3,881,063 | 4/1975 | Mawake et al. | 179/15 BT |

OTHER PUBLICATIONS

"4-Channel FM," Radio Electronics, by Len Feldman, Oct. 1973, pp. 40, 41, 42, 98, & 100.

*Primary Examiner*—Douglas W. Olms
*Attorney, Agent, or Firm*—Flynn & Frishauf

[57] ABSTRACT

Improvements in a stereo signal demodulator of a receiver in a four-channel stereo system, in which system upon transmitting four sound source signals (LF, LB, RF and RB) from one station, the transmission is carried out for a synthesized signal composed of a signal in a main channel of (LF + LB) + (RF + RB), a pilot signal, a signal in a first sub-channel consisting of a double side-band signal obtained by modulating an *m*-multiple frequency-multiplied signal of the pilot signal with a signal of (LF + LB) − (RF + RB), a signal in a second sub-channel consisting of a double side-band signal obtained by modulating the same, *m*-multiple frequency-multiplied but phase-shifted signal with a signal of (LF − LB) + (RF − RB), and a signal in a third sub-channel consisting of a single side-band signal (SSB or VSB) obtained by modulating an *n*-multiple (m < n) frequency-multiplied signal of the pilot signal with a signal of (LF − LB) − (RF − RB). The four-channel stereo signal demodulator comprises a circuit for deriving from the pilot signal in said synthesized signal that has been FM-detected by a tuner an *m*-multiple frequency-multiplied signal of said pilot signal, a signal obtained by phase-shifting said *m*-multiple frequency-multiplied signal, and an *n*-multiple frequency-multiplied signal of said pilot signal; first, second and third switching circuits for switching their input signals consisting of said synthesized signal, respectively, under control of the respective three outputs of said signal deriving circuit to demodulate the signals in said respective channels from said synthesized signal; and a matrix circuit having the outputs of said three switching circuits applied to its input for separating and emitting at its output the signals LF, LB, RF and RB. The improvements reside in that a filter and a phase-compensator circuit are electrically coupled in the input circuit for the synthesized signal to said third switching circuit, and in that the outputs of said first and second switching circuits are applied to the input of the matrix circuit through the intermediary of respective delay lines.

31 Claims, 23 Drawing Figures

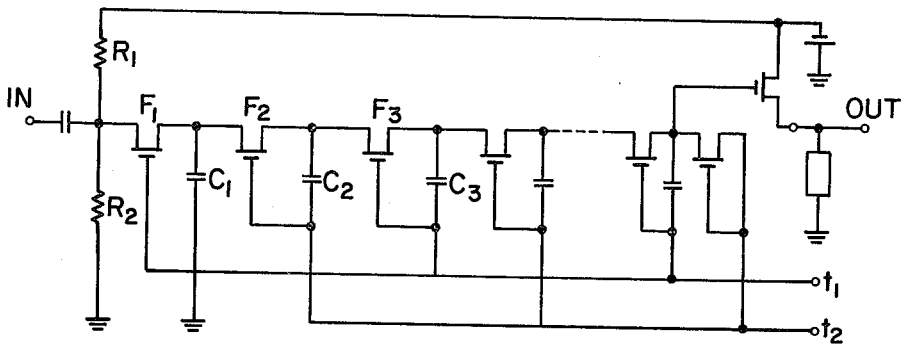
FIG.6
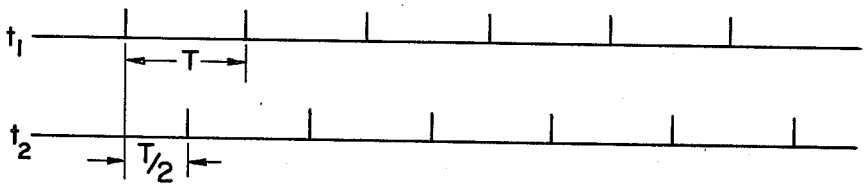
FIG. 7
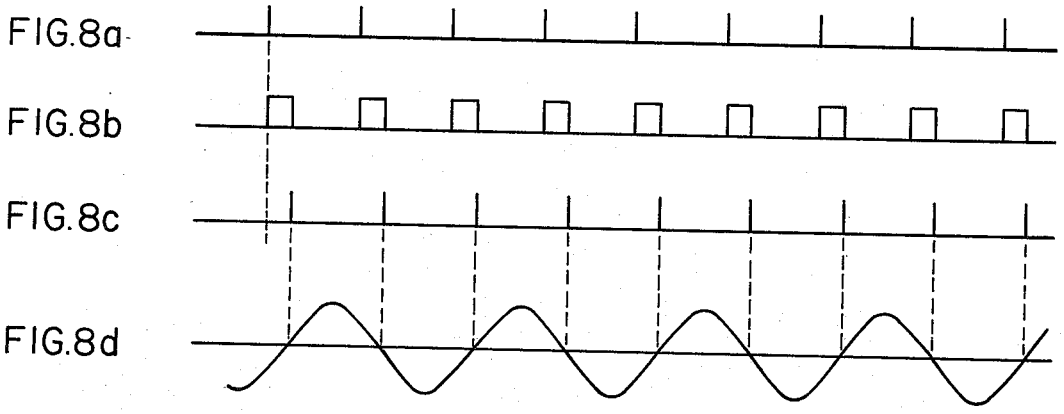

STEREO SIGNAL DEMODULATOR IN A FOUR-CHANNEL STEREO BROADCAST RECEIVER

BACKGROUND OF THE INVENTION

The present invention relates to a four-channel stereo broadcast receiver, and more particularly to a construction of a demodulator in such a receiver.

In place of the conventional two-channel stereo system, four-channel stereo systems have been developed to a point such that they are now practically available with respect to stereo disc records and stereo tape recorders. In the available systems, signals from four sound sources at the left front, left back, right front and right back positions (hereinafter referred to, respectively, as LF, LB, RF and RB for the sake of simplicity) are reproduced by four speakers disposed at the left front, left back, right front and right back positions for reproducing the original sounds with higher fidelity. Simultaneously therewith, in the field of FM-broadcasting, trials for four-channel stereo broadcasting are about to be conducted experimentally.

Although various systems are known to implement four-channel stereo broadcasting, as a representative one a system is known, in which a signal of (LF + LB) + (RF + RB) is borne by a main channel M, a signal of (LF + LB) − (RF + RB) is borne by a first sub-channel $S_1$, a signal of (LF − LB) + (RF − RB) is borne by a second sub-channel $S_2$, a signal of (LF − LB) − (RF − RB) is borne by a third sub-channel $S_3$, and these signals are transmitted together with a pilot signal P (19 $KH_z$) as a synthesized signal, as shown in FIGS. 1*a* – 1*d*. Then the first sub-channel $S_1$ comprises a double side-band signal (DSB) obtained by modulating an *m*-multiple (normally double) frequency-multiplied signal (38 $KH_z$) of the pilot signal with the signal of (LF + LB) − (RF + RB). The second sub-channel $S_2$ comprises a double side-band signal (DSB) obtained by modulating an m-multiple frequency-multiplied and phase-shifted (normally by $\pi/2$) signal (38 $KH_z$) of the pilot signal with the signal of (LF − LB) + (RF − RB). The third sub-channel $S_3$ comprises a single side-band signal (SSB) obtained by modulating an *n*-multiple ($m<n$ and normally $n=4$) frequency-multiplied signal (76 $KH_z$) of the pilot signal with the signal of (LF − LB) − (RF − RB) (In the systems shown in FIGS. 1*a* and 1*c* a lower side-band is selected, while in the systems shown in FIGS. 1*b* and 1*d* an upper side-band is selected.). Here it is to be noted that the third sub-channel may comprise, in some cases, an asymmetrical or vestigial side-band signal (VSB) that is one kind of single side-band, as shown in FIGS. 1*c* and 1*d*.

The present invention relates to a construction of a demodulator in a receiver to be used in the four-channel stereo broadcasting systems of the type described above. As the construction of such receiver, a circuit construction as shown in FIG. 2 has been heretofore proposed.

Referring now to FIG. 2, which illustrates a prior art receiver, a high frequency signal received by an antenna AT is subjected to HF-amplification and IF-amplification in a tuner TU, and thereafter it is FM-detected in the tuner TU to provide the above-referred synthesized signal. The synthesized signal fed from the tuner TU is applied to a pilot signal amplifier PA, in which the pilot signal (19 $KH_z$) is amplified. The amplified pilot is frequency-multiplied by a factor of *m* (normally by a factor of 2) in a first frequency-multiplier $Mul_1$, and then it is applied to a first switching circuit $Sw_1$. The output signal of the frequency-multiplier $Mul_1$ is applied to a phase-shifter PS and a second frequency-multiplier $Mul_2$. The phase-shifter PS shifts the phase of the output signal of the frequency-multiplier $Mul_1$ (normally by $\pi/2$) and feeds the phase-shifted signal to a second switching circuit $SW_2$. The second frequency-multiplier $Mul_2$ further multiplies the frequency of the output of the first frequency multiplier $Mul_1$ to emit at its output a signal having a frequency *n* times (normally $n=4$) higher than the frequency of the pilot signal, and it feeds this output signal to a third switching circuit $SW_3$.

The first, second and third switching circuits $SW_1$, $SW_2$ and $SW_3$ are also applied with a synthesized signal appearing at the output of the tuner TU. Accordingly, in the first switching circuit are demodulated the main channel and the first sub-channel to provide the signals of (LF + LB) and (RF + RB), in the second switching circuit is demodulated the second sub-channel to provide a signal of (LF − LB) + (RF − RB) and an opposite phase signal thereof, and in the third switching circuit is demodulated the third sub-channel to provide a signal of (LF − LB) − (RF − RB) and an opposite phase signal thereof. These demodulated signals are fed to a de-matrix circuit $M_x$ in which each of the LF, LB, RF and RB signals is separately obtained. In FIG. 2, blocks designated by B.A. represent buffer amplifiers. It is to be noted that in the aforementioned construction, the pilot signal amplifier PA is preferably constructed as a phase-locked type amplifier.

In the circuit shown in FIG. 2, the demodulation of the third sub-channel $S_3$ is carried out through switching with a switching signal of, for example, 76 $KH_z$ to the signal shown in FIG. 1, so that frequency components extending over the double side-band, for example, frequency components 61 $KH_z$ – 91 $KH_z$, are demodulated. Therefore, in the systems shown in FIG. 1 which use a single side-band as the third sub-channel, unnecessary frequency components existing in the other side-band (in FIGS. 1*a* and 1*c* 76–91 $KH_z$, and in FIGS. 1*b* and 1*d* 61–76 $KH_z$) would appear in the demodulated signal, resulting in noise, thus degrading the S/N ratio of the demodulated signal.

SUMMARY OF THE INVENTION

It is one object of the present invention to provide a demodulator for a four-channel stereo signal having a good S/N ratio in view of the aforementioned disadvantages in the prior art.

Another object of the present invention is to provide a demodulator that is simple in structure and that demodulates only a single side-band forming a third sub-channel.

Still another object of the present invention is to provide a demodulator in which no phase difference is produced in the demodulated signals in the main channel and the first, second and third sub-channels.

According to one feature of the present invention there is provided a stereo signal demodulator of a receiver in a four-channel stereo system, in which system transmission is carried out for a synthesized signal composed of a signal in a main channel of (LF + LB) + (RF + RB), a pilot signal, a signal in an first sub-channel comprised of a double side-band signal obtained by modulating a *m*-multiple frequency-multiplied signal of the pilot signal with a signal of (LF + LB) − (RF + RB), a signal in a second sub-channel comprised of a double side-band signal obtained by modulating the same $m$-multiple frequency-multiplied but phase-shifted signal with a signal of (LF − LB) + (RF − RB), and a signal in a third sub-channel comprised of a single side-band signal (SSB or VSB) obtained by modulating an $n$-multiple ($m<n$) frequency-multiplied signal of the pilot signal with a signal of (LF − LB) − (RF − RB). The four-channel stereo signal demodulator of the present invention comprises circuit means for deriving from the pilot signal in said synthesized signal that has been FM-detected by a tuner, an $m$-multiple frequency-multiplied signal of said pilot signal, a signal obtained by phase-shifting said $m$-multiple frequency-multiplied signal, and an $n$-multiple frequency-multiplied signal of said pilot signal; first, second and third switching circuits for switching their input signals comprised of said synthesized signal, respectively, under control of the respective three outputs of said signal deriving circuit means to demodulate the signals in said respective channels from said synthesized signal; and a matrix circuit having the outputs of said three switching circuits applied to its input for separating and emitting at its output the signals LF, LB, RF and RB; characterized in that a filter and a phase-compensator circuit are electrically coupled in the input circuit for the synthesized signal to said third switching circuit respective delay lines are provided for coupling, and in that the outputs of said first and second switching circuits to the input of the matrix circuit.

Here it is to be noted that in the conventional channel stereo broadcasting the values of $m=2$ and $n=4$ are selected and the pilot signal is selected to be 19 $KH_z$ (However, the present invention is not be limited to these specific values.).

These and other features and objects of this invention will become more apparent from the following description of its preferred embodiments taken in conjunction with the accompanying drawings.

BRIEF DESCRIPTION OF THE DRAWINGS

FIG. 6 is a detailed circuit diagram of an electronic delay line, FIG. 7 shows clock pulses to be applied to clock signal terminals $t_1$ and $t_2$ of the electronic delay line in FIG. 6, and FIGS. 8*a*–8*d* are diagramatic views of waveforms of different signals for explaining the operation of a logical delay circuit in the embodiment shown in FIG. 3*b*, FIG. 8*a* showing a differential signal of the output from the switching signal generator, FIG. 8*b* showing the output of each logical delay circuits, FIG. 8*c* showing a pulse train applied to each terminal of $t_1$ or $t_2$ (FIG. 6), and FIG. 8*d* showing the residual AM.DSB.

DETAILED DESCRIPTION OF PREFERRED EMBODIMENTS

Figure 2:
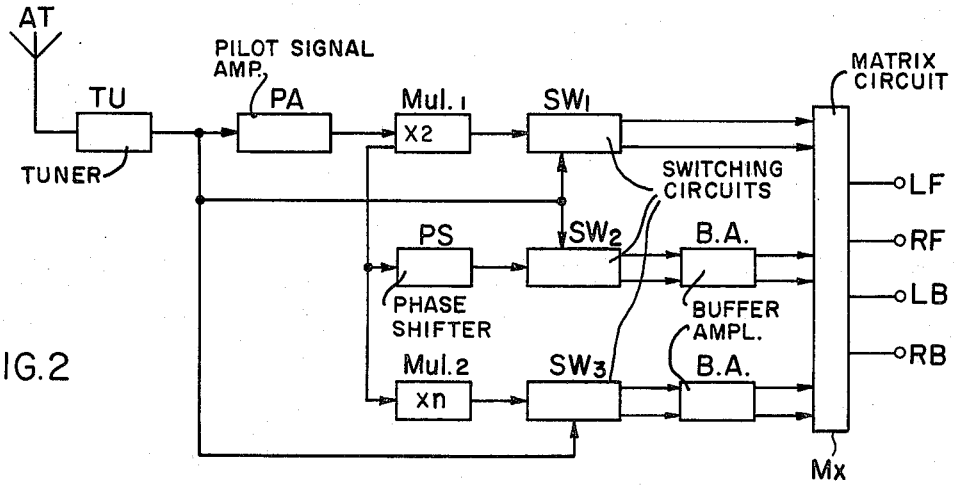
FIG. 2 is a block diagram showing a construction of a demodulator in the conventional four-channel stereo receivers.
Figure 3A:
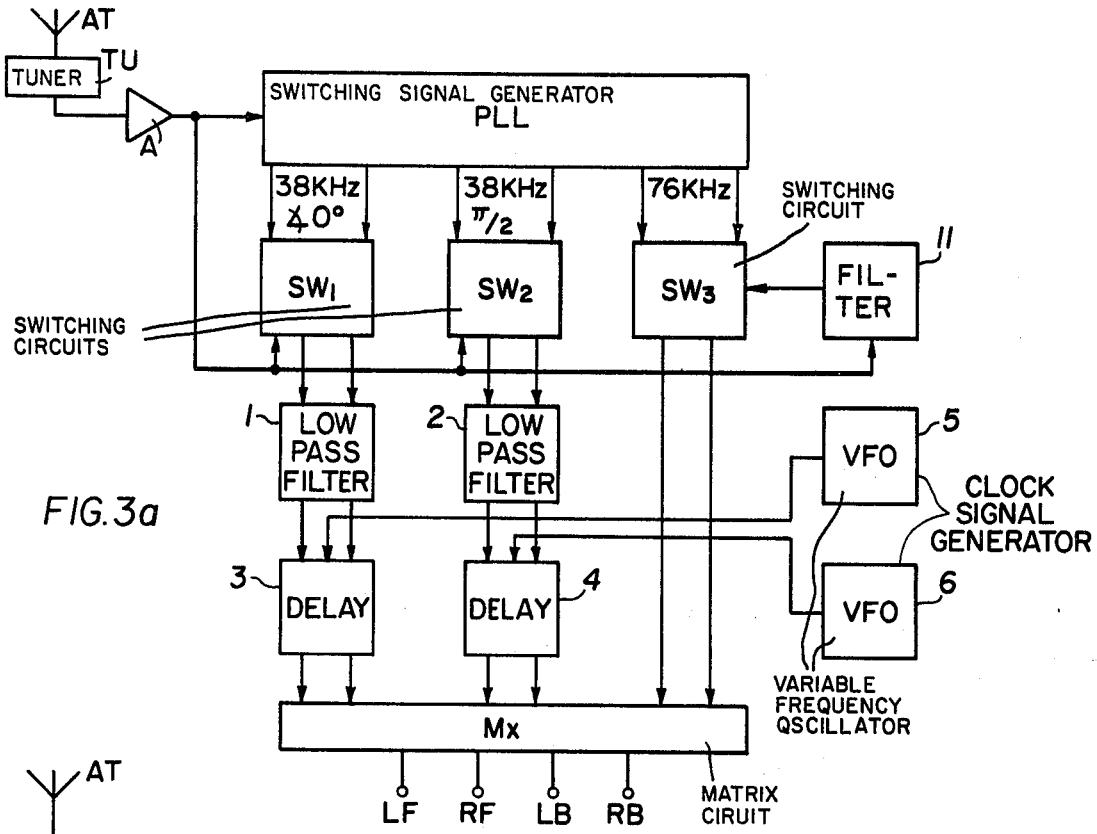
FIGS. 3*a* to 3*c* are block diagrams showing various preferred embodiments of the demodulator according to the present invention.

Referring now to FIG. 3*a* of the drawings, one preferred embodiment of the present invention is shown in block form, in which a signal received by an antenna AT is subjected to HF-amplification and IF-amplification in a tuner TU and thereafter it is FM-detected in tuner TU to derive the synthetic signal similarly to the conventional circuit construction as shown in FIG. 2. This synthesized signal is, after being amplified by an amplifier A, applied to a switching signal generator PLL.

Figure 3B:
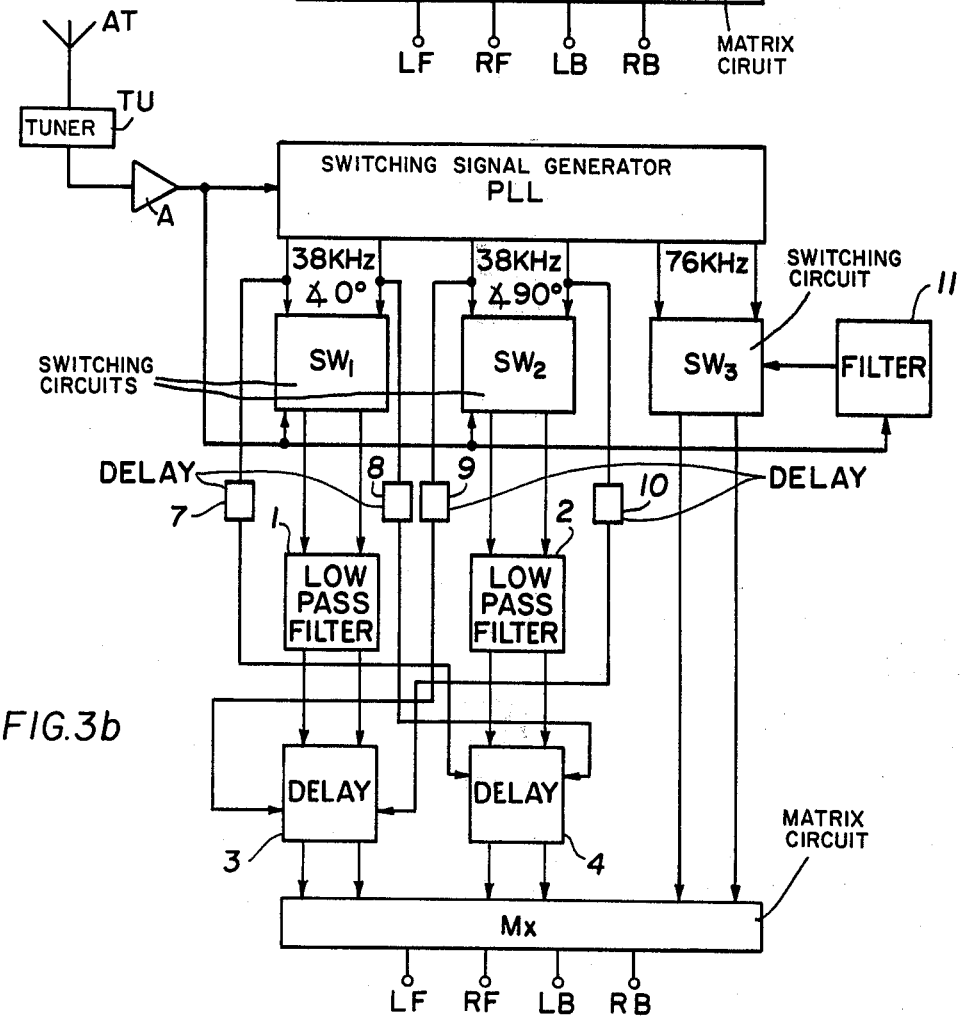
Figure 3C:
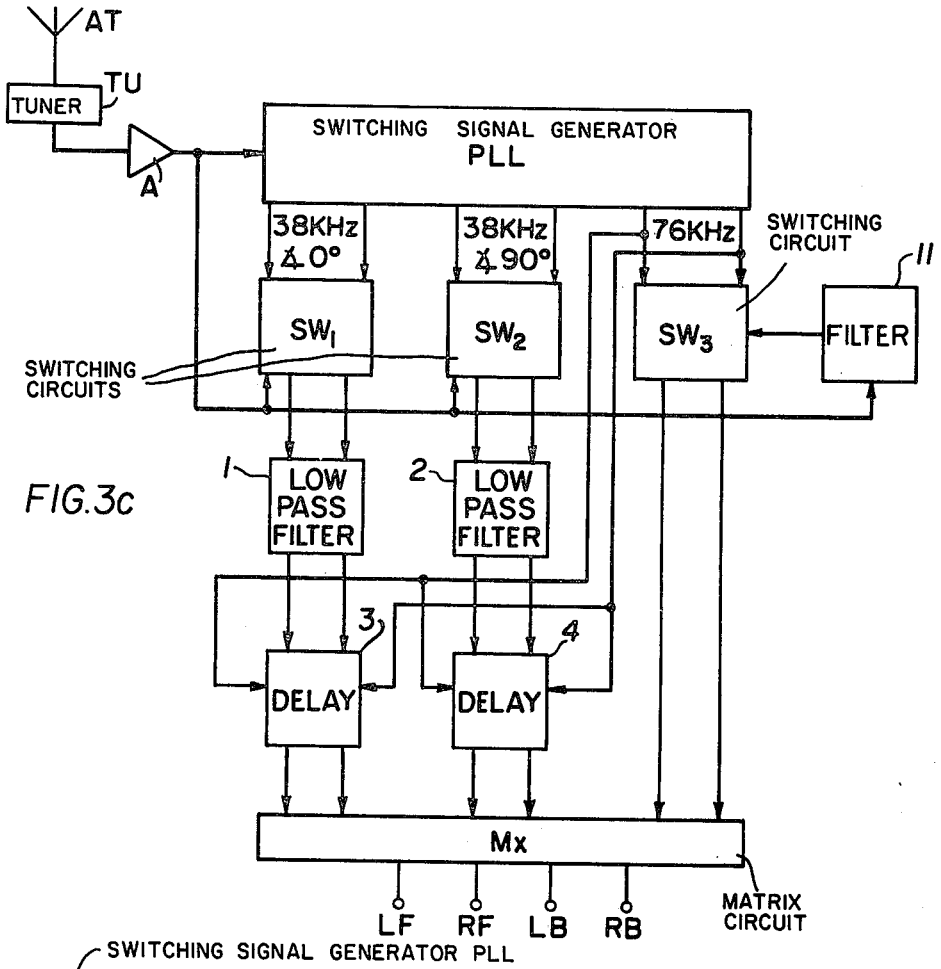
Figure 3D:
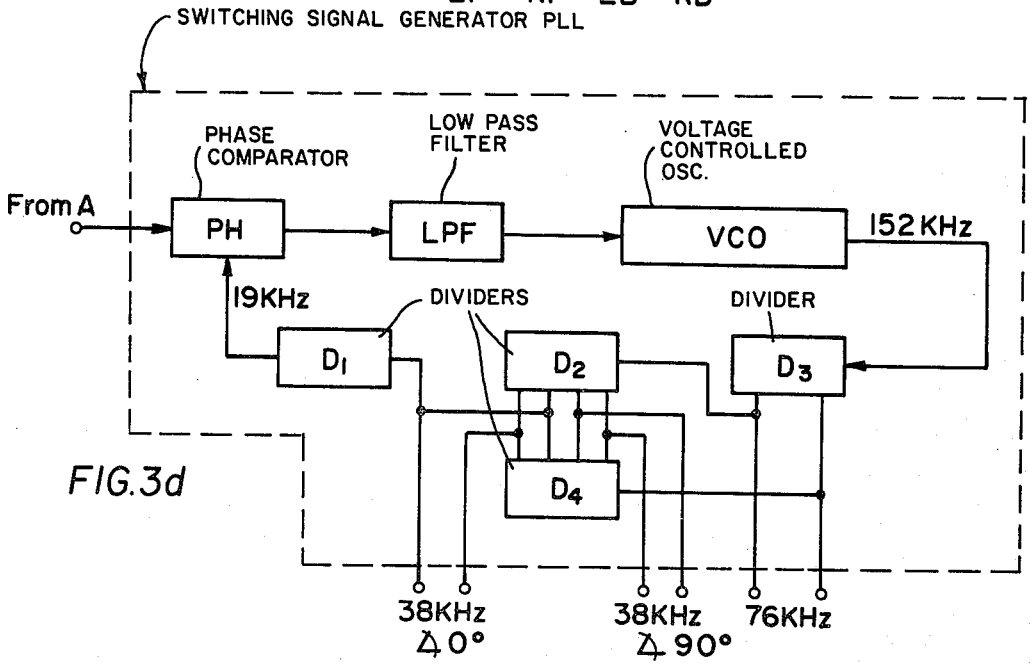
FIG. 3*d* shows a block diagram of the switching signal generator PLL in FIGS. 3*a*–3*c*, FIGS. 3*e* and 3*f* show modifications of the demodulators of FIGS. 3*b* and 3*c*, respectively.

As shown in FIG. 3d, the switching signal generator PLL comprises a phase comparator PH, a low-pass filter LPF, voltage controlled oscillator VCO and four dividers $D_1$, $D_2$, $D_3$ and $D_4$ and it generates three switching signals such as, for example, 38 $KH_z$ 0°, 38 $KH_z$ 90° and 76 $KH_z$ as indicated in FIG. 3*d*. The respective switching signals are applied to the first, second and third switching circuits $SW_1$, $SW_2$ and $SW_3$, respectively, similarly to the case of FIG. 2.

The first and second switching circuits $SW_1$ and $SW_2$ are directly applied with the synthesized signal received from the output of the tuner TU, and they demodulate the main channel and first sub-channel and the second sub-channel, respectively, through switching action. The third switching circuit $SW_3$ is applied with the synthesized signal from the output of the tuner TU through the intermediary of a filter and phase-compensator 11, and it demodulates the third sub-channel through switching action.

The filter and phase-compensator 11 is provided for the purpose of cutting out the single side-band on the suppressed side of the third sub-channel (in FIGS. 1*a* and 1*c* 76–91 $KH_z$, and in FIGS. 1*b* and 1*d* 61–76 $KH_z$).

Accordingly, the unnecessary frequency components existing within the single side-band on the suppressed side would never mix in the output signal of the third switching circuit $SW_3$ due to the demodulation, so that noises are not possibly produced and the S/N ratio is thereby improved.

Therefore, if the output demodulated signals of the switching circuits $SW_1$, $SW_2$ and $SW_3$ are applied to the input of the matrix circuit $M_x$, then the LF, LB, RF and RB signals are advantageously separated and derived at its output.

However, since the synthesized signal is passed through a filter (band-pass filter) 11 prior to the demodulation of the third channel, a delay is introduced at the filter, and so, there occurs a deviation in time between the outputs of the first and second switching circuits $SW_1$ and $SW_2$ and the output of the third switching circuit $SW_3$. Therefore, if these output signals are applied directly to the matrix, then the separation of the respective signals is degraded.

Figure 1A:
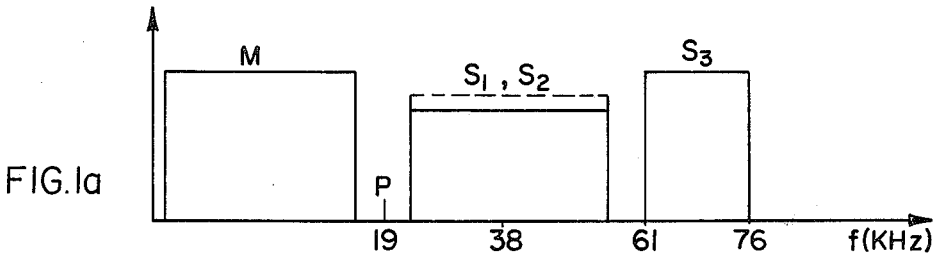
FIGS. 1*a* to 1*d* diagramatically show different examples of a synthesized signal wave in a four-channel stereo system.
Figure 1B:
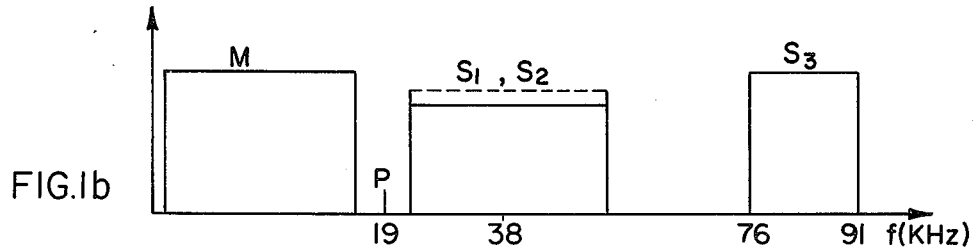
Figure 1C:
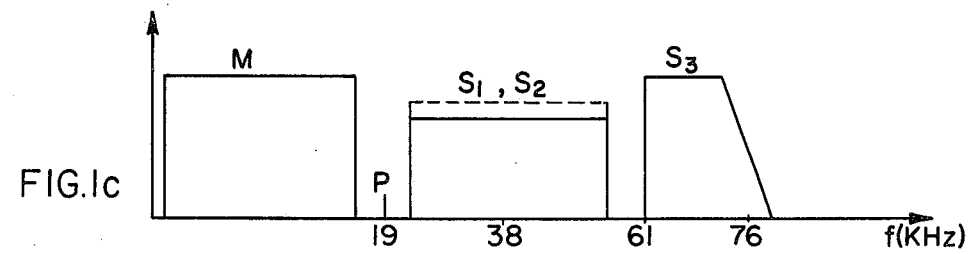
Figure 1D:
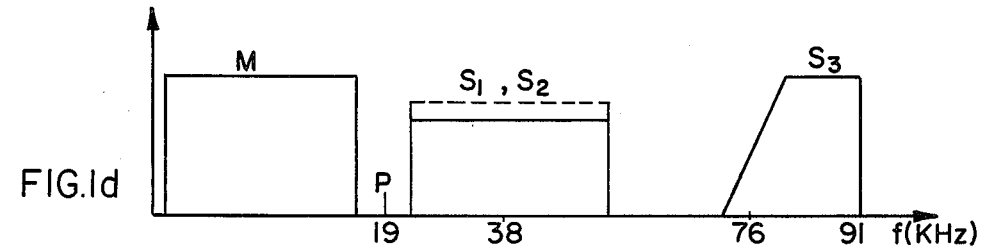
Figure 4A:
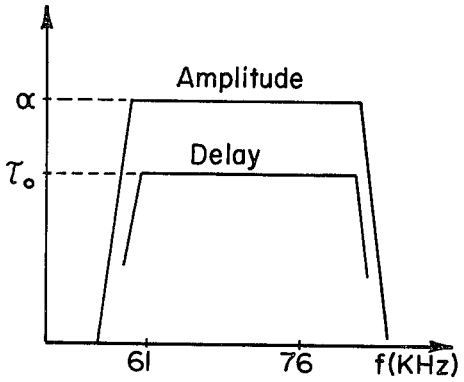
FIGS. 4*a* to 4*d* are diagrams showing amplitude and delay characteristics of a band-pass filter for the respective ones of the synthesized signal waves shown in FIG. 1, FIGS. 5*a* and 5*b* are diagrams showing the relations of separation vs. delay time and separation vs. frequency, respectively, of the third sub-channel.
Figure 4B:
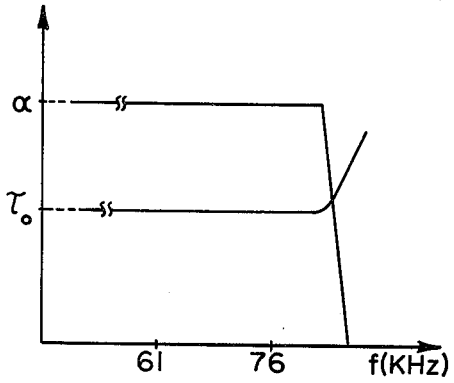
Figure 4C:
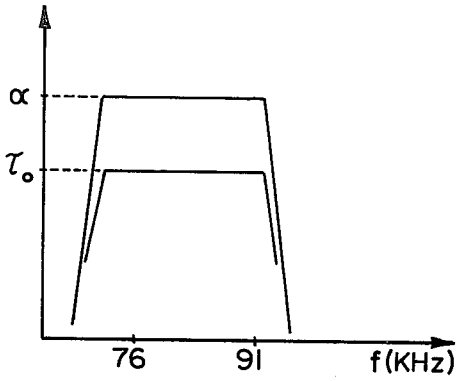
Figure 4D:
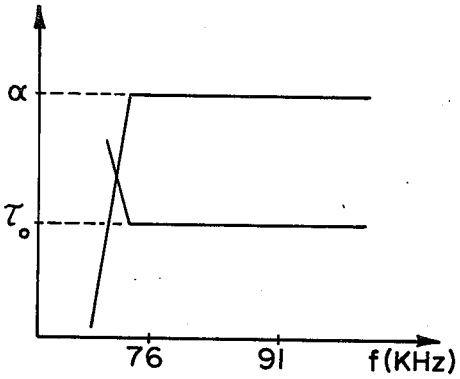

The amplitude and delay characteristics of the band-pass filter to be used for the synthesized signal wave shown in FIG. 1*a* or 1*c* are as shown in FIG. 4*a* or 4*b*, respectively while the same characteristics of the band-pass filter to be used for the synthesized signal wave shown in FIG. 1*b* or 1*d* are as shown in FIG. 4*c* or 4*d*, respectively. More particularly, when the signal wave is passed through a band-pass filter, a time delay of $\tau_0$ would always be produced as shown in FIGS. 4*a*–4*d*.

Figure 5A:
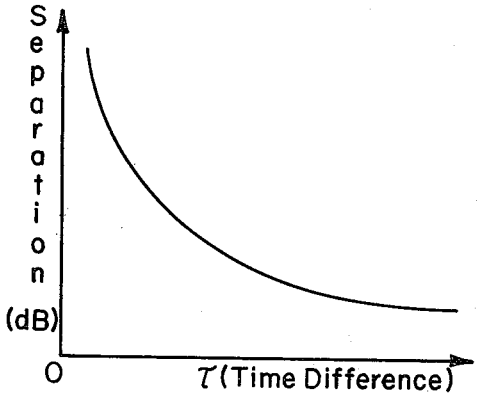
Figure 5B:
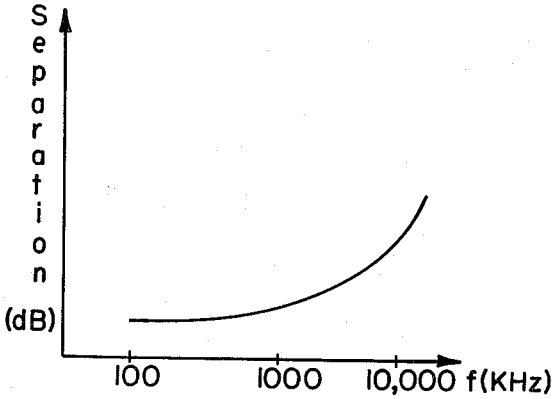

The relationships of separation vs. time difference $\tau$ and separation vs. frequency are shown in FIGS. 5*a* and 5*b*, respectively.

Accordingly, in order to obtain a high degree of separation, it is necessary to delay the output demodulated signals of the first and second switching circuits $SW_1$ and $SW_2$ and thereby eliminate the time differences between these output signals and the output signal of the third switching circuit $SW_3$.

For that purpose, on the output side of the first and second switching circuits $SW_1$ and $SW_2$ are serially inserted low-pass filters 1 and 2 and electronic delay lines 3 and 4 respectively, as shown in FIG. 3*a*. Reference numerals 5 and 6 designate clock signal generators for the electronic delay lines 3 and 4, respectively. Preferably they are composed of a variable frequency oscillator (VFO).

The demodulated signals of the main channel M and the first sub-channel $S_1$ which have been demodulated in the first switching circuit $SW_1$, are applied to the low-pass filter 1 that is a flat-delay low-pass filter having a cut-off frequency sufficiently higher than the audio frequency band. This low-pass filter 1 is inserted for the purpose of preventing beat interference from occuring in the electronic delay line 3 in the next step. However, if the oscillation frequency of the variable frequency oscillator 5 is preset at such frequency that the beat may not be produced in the electronic delay line, then the use of the low-pass filter 1 is not always necessary.

As the electronic delay line 3, for example a circuitas shown in FIG. 6 can be used. The circuit shown in FIG. 6 is known as a CCD (Charge Coupled Device).

In operation of the circuit shown in FIG. 6, the signal fed from the low-pass filter 1 is applied to a terminal IN. To terminals $t_1$ and $t_2$ are applied pulse trains as shown in FIG. 7 from the variable frequency oscillator 5. More particularly, the input pulse trains applied to the terminals $t_1$ and $t_2$ are pulse signals having the same frequency and differring in phase from each other by T/2, where T is a period of the pulse trains. In response to a pulse applied to the terminal $t_1$, an information signal fed through the terminal IN is read into a capacitor $C_{2k-1}$, (k-1)T after the first read-in into a capacitor $C_1$, where $k$ is any arbitrary positive integer. Similarly in response to a pulse applied to the terminal $t_2$, the same information is read into a capacitor $C_{2k}$, (k- ½)T after the first read-in into the capacitor $C_1$, where $k$ is any arbitrary positive integer. That is, an information signal read into the capacitor $C_{2k-1}$ is transferred to the capacitor $C_{2k}$ in response to the next subsequent pulse applied to the terminal $t_2$. These transfer operations are repeated in this electronic delay line, and consequently, if the number of the capacitor steps in the electronic delay line is K (K=2k-1 or 2k), then the electronic delay line provides a delay time $$\tau = \frac{(K-1)\,T}{2}$$

In order to match the delay time $\tau_0$ of the filter 11 in FIG. 3*a* with this delay time $\tau$, the frequency and accordingly the period T of the output of the variable frequency oscillator 5 are made variable and are adjusted so that $\tau_0$ may coincide with $\tau$. The circuit section connected to the second switching circuit $SW_2$ comprising low-pass filter 2 -electronic delay line 4-variable frequency oscillator 6 is similar to the above-described circuit section comprising elements 1-3-5, and therefore, further explanation thereof will be omitted.

When a practical broadcast is carried out employing the synthesized signal as shown in FIGS. 1*a* through 1*d* and the synthesized signal has been demodulated by a receiver, there occur time differences between the main channel M and the sub-channels $S_1$ and $S_2$, and between the sub-channels $S_1$ and $S_2$ and the sub-channel $S_3$ in effect, because the frequency response of the FM-detector is not flat within the frequency range lower than 91 $KH_z$. Therefore, if two separate variable frequency oscillators 5 and 6 are employed as shown in FIG. 3*a*, and if the periods T of the respective oscillators are made separately variable, then the two circuit sections 1-3-5 and 2-4-6 can be preset to have individually optimum delay times $\tau$. It is to be noted that the frequency response of the circuit shown in FIG. 6 can be made flat up to 91 $KH_z$ if T is selected to be sufficiently short, and also the delay characteristics are flat in the frequency range lower than 1/T.

In a modified embodiment shown in FIG. 3*b*, in place of the oscillation output of the variable frequency oscillators 5 and 6 in FIG. 3*a*, the output of 38 $KH_z$ from the switching signal generator PLL is employed. The remaining part of the construction is similar to the construction shown in FIG. 3*a*.

In the circuit shown in FIG. 3*b*, to the terminals $t_1$ and $t_2$ of the electronic delay line 3 associated with the first switching circuit $SW^1$ are applied pulses having a frequency of 38 $KH_z$ and a phase difference of $\pi/2$ from switching signal of the first switching circuit $SW_1$, and similar modification is made to the electronic delay line 4 associated with the second switching circuit $SW_2$. It is well-known that even if switching is made for an AM.DSB in the synthesized signal with a switching signal having a phase difference of $\pi/2$, it cannot be demodulated into a voice signal. In the embodiment shown in FIG. 3*b*, this effect has been utilized in an electronic delay line. If such a provision is made, no disadvantage would arise even though the cut-off frequency of the low-pass filters 1 and 2 is selected sufficiently higher than the audio frequencies and even though the AM.DSB signal is contained in the output of the filters to a certain extent.

Reference numerals 7 to 10 designate logical delay circuits. The residual AM.DSB component having appeared in the low-pass filters 1 and 2 is subjected to a phase shift as shown in FIG. 8*d*. It is necessary to prevent this residual AM.DSB from being demodulated by the electronic delay line. Therefore, it is necessary to delay the output of the switching pulse generator PLL. In other words, the pulse trains applied to terminals $t_1$ and $t_2$ of the electronic delay lines are delayed by the logical delay circuits 7 to 10 so as to have the aformentioned phase $\pi/2$ (See FIGS. 8*a*, 8*b* and 8*c*).

In this case, the delay time of the electronic delay line 3 and 4 is equal to $$\tau = \frac{K-1}{2 \times 38 \times 10^3}\ \text{sec}$$

It is to be noted that although only a single stage of electronic delay line is employed in each channel in the circuit in FIG. 3*b*, a multiple plurality of stages of electronic delay lines could be used. In such a modification, at the additional stage or stages a signal having a frequency of *N*(any arbitrary positive integer) times as high as the clock signal frequency at the first stage of 38 $KH_z$ could be preferably applied to the terminals $t_1$ and $t_2$.

Figure 3E:
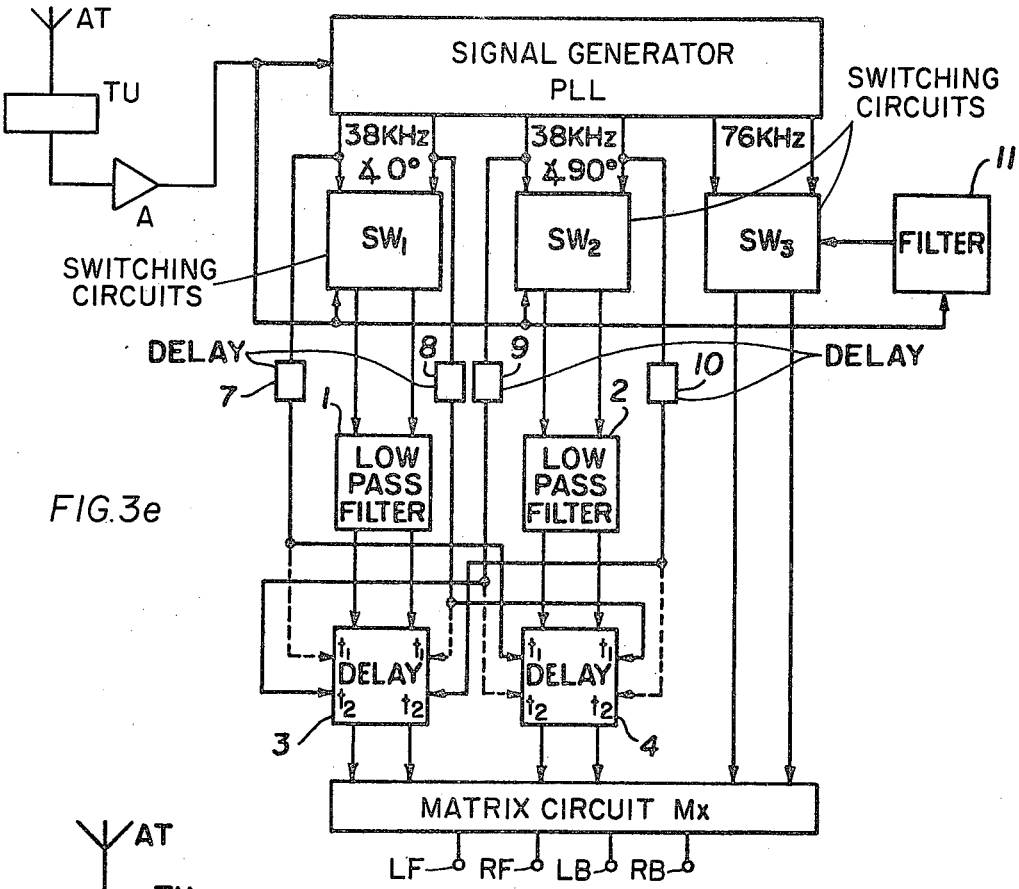

If the phases of the outputs from the low-pass filters 1 and 2 are different from the phases of the outputs from the two pairs of logical delay circuits 7-8 and 9-10 by $\pi/2$, respectively, the outputs from the two pairs of logical delay circuits, 7-8 and 9-10 may be used as pulse trains applied to terminals $t_1$ and $t_2$ of the electronic delay lines 3 and 4, respectively as shown by broken lines in FIG. 3*e*.

Figure 3F:
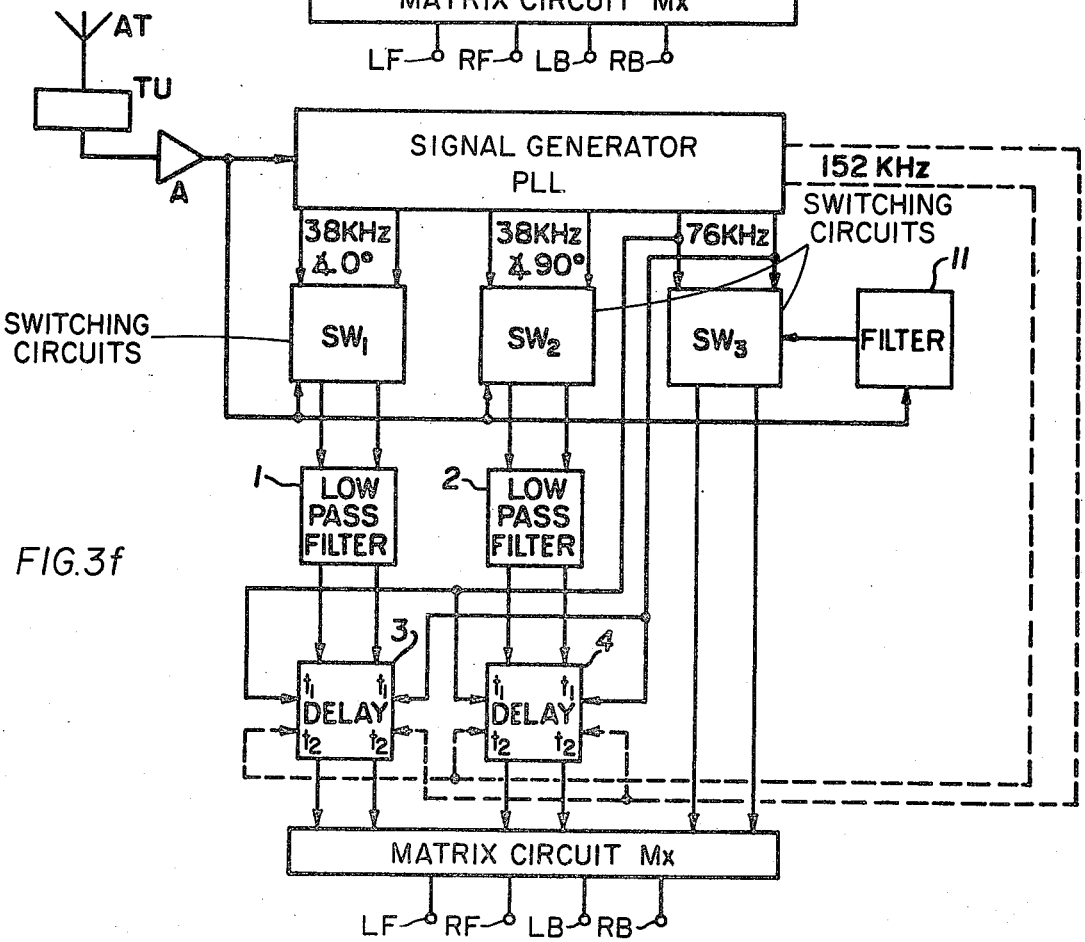

In aother modified embodiment shown in FIG. 3f, pulse trains having a frequency of 76 $KH_z$ or 152 $KH_z$ fed from PLL are used as the clock pulses applied to the terminals $t_1$ and $t_2$ of the electronic delay lines 3 and 4. FIG. 3*f* differs from FIG. 3*c* by the provision of the connection shown in broken lines. In this way, if a signal having a frequency of M(any arbitrary positive integer) times as high as the frequency of the AM.DSB wave is applied to the terminals $t_1$ and $t_2$, then a D.C. component (a voice signal component) would not be produced even though the residual AM.DSB wave exists, so that a similar effect to that of the embodiment in FIG. 3*b* can be obtained. Therefore, PLL could be utilized to form a synchronous oscillator for generating a signal having a frequency M times as high as the AM.DSB wave, and this signal could be applied to the terminals $t_1$ and $t_2$ (no beat is produced because of the synchronized relationship.). In this case, the delay time is equal to $$\tau = \frac{K-1}{2 \times M \times 38 \times 10^3} (\text{sec})$$

As described above, according to the present invention, a demodulator having an improved S/N ratio and a high degree of separation can be realized with a simple construction.

While I have described above the principles of my invention in connection with specific apparatus, it is to be clearly understood that this description is made only by way of example and not as a limitation to the scope of the invention as set forth in the objects thereof and in the accompanying claims.

What is claimed is:

1. A stereo signal demodulator for a receiver in a four-channel stereo system in which four sound source signals (Lf, LB, RF and RB) are transmitted from one station, the transmission being carried out for a synthesized signal comprising a signal in a main channel of (LF+LB)+(RF+RB), a pilot signal, a signal in a first sub-channel comprising a double side-band signal obtained by modulating an m-multiple frequency-multiplied signal of the pilot signal with a signal of (LF + LB) − (RF + RB), a signal in a second sub-channel comprising a double side-band signal obtained by modulating the same m-multiple frequency-multiplied but phase-shifted signal with a signal of (LF − LB) + (RF−RB), and a signal in a third sub-channel comprising a single side-band signal (SSB) obtained by modulating an n-multiple (m<n) frequency-multiplied signal of the pilot signal with a signal of (LF −LB) − (RF − RB);

the four-channel stereo signal demodulator comprising:

signal deriving circuit means including means for deriving from the pilot signal in said synthesized signal that has been FM-detected by a tuner an m-multiple frequency-multiplied signal of said pilot signal, a signal obtained by phase-shifting said *m*-multiple frequency-multiplied signal, and an n-multiple frequency-multiplied signal of said pilot signal;

first, second and third switching circuits for switching their input signals comprised of said synthesized signal, respectively, under control of the respective three outputs of said signal deriving circuit means to demodulate the signals in said respective channels from said synthesized signal;

a matrix circuit having the outputs of said three switching circuits applied to its inputs for separating and emitting at its output the signals LF, LB, RF and RB;

a filter and a phase-compensator circuit coupling said synthesized signal to the input of said third switching circuit; and first and second delay means coupling the outputs of said first and second switching circuits to the inputs of said matrix circuit.

2. A stereo signal demodulator according to claim 1 wherein said synthesized signal is coupled directly to the inputs of said first and second switching circuits.

3. A stereo signal demodulator according to claim 1 further comprising respective low pass filters coupling said first and second switching circuits to said first and second delay means.

4. A stereo signal demodulator according to claim 3 wherein said third switching circuit is coupled directly to said matrix circuit.

5. A stereo signal demodulator according to claim 1 including clock signal generator means coupled to said first and second delay means.

6. A stereo signal demodulator according to claim 1 wherein the inputs to said first switching means from said signal deriving circuit means are further coupled to said second delay means via respective ones of a first pair of delay means, and wherein the inputs to said second switching circuit from said signal deriving circuit means are coupled to said first delay means via respective ones of a second pair of delay means, the signals, supplied to said first and second delay means via said pairs of delay means serving as clock signal sources therefor.

7. A stereo signal demodulator according to claim 1 wherein the inputs to said third switching circuit from said signal deriving circuit means are applied to said first and second delay means to serve as clock signal sources therefor.

8. A stereo signal demodulator according to claim 1 wherein said *n*-multiple frequency-multiplied signal is twice the frequency of said *m*-multiple frequency-multiplied signal.

9. A stereo signal demodulator according to claim 8 wherein said *m*-multiple frequency-multiplied signal is a 38 kHz signal, said phase-shifted *m*-multiple frequency-multiplied signal is a signal of frequency 38 kHz at an angle of $\pi/2$, and wherein said *n*-multiple frequency-multiplied signal is a signal of frequency 76 kHz.

10. A stereo demodulator according to claim 1 wherein said first and second delay lines each comprise a charge-coupled device.

11. A stereo signal demodulator according to claim 10 wherein each of said first and second delay lines comprises a plurality of capacitor stages coupled in series with each other, each of said stages including a storage capacitor and means for transferring a charge on said storage capacitor to the storage capacitor of the next successive stage, every other stage being coupled to a first clock pulse terminal and every other remaining stage being coupled to a second clock pulse terminal, whereby successive clock pulses applied to said first and second terminals cause transfer of said charge from the capacitor of one stage to the capacitor of the next successive stage.

12. A stereo signal demodulator according to claim 11 further including a source of first and second clock pulses which are respectively coupled to said first and second clock pulse terminals of said respective first aand second delay means, said clock pulses being out of phase with each other by 180°.

13. A stereo signal demodulator for a receiver in a four-channel stereo system in which four sound source signaals (LF. LB, RF and RB) are transmitted from one station, the transmission being carried out for a synthesized signal comprising a signal in a main channel of (LF+LB)+(RF+RB), a pilot signal, a signal in a first sub-channel comprising a double side-band signal obtained by modulating an $m$-multiple frequency-multiplied signal of the pilot signal with a signal of (LF+LB)−(RF+RB), a signal in a second sub-channel comprising a double side-band signal obtained by modulating the same $m$-multiple frequency-multiplied but phaseshifted signal with a signal of (LF−LB)+(RF−RB), and a signal in a third sub-channel comprising a vestigial side-band signal (VSB) obtained by modulating an $n$-multiple ($m<n$) frequency-multiplied signal of the pilot signal with a signal of (LF−LB)−(RF−RB):

the four-channel stereo signal demodulator comprising:

signal deriving circuit means including means for deriving from the pilot signal in said synthesized signal that has been FM-detected by a tuner an $m$-multiple frequency-multiplied signal of said pilot signal, a signal obtained by phase-shifting said $m$-multiple frequency-multiplied signal, and an $n$-multiple frequency-multiplied signal of said pilot signal;

first, second and third switching circuits for switching their input signals comprised of said synthesized signal, respectively, under control of the respective three outputs of said signal deriving circuit means to demodulate the signals in said respective channels from said synthesized signal;

a matrix circuit having the outputs of said three switching circuits applied to its inputs for separating and emitting at its output the signals LF, LB, RF and RB;

a filter and a phase-compensator circuit coupling said synthesized signal to the input of said third switching circuit; and first and second delay means coupling the outputs of said first and second switching circuits to the inputs of said matrix circuit.

14. A stereo signal demodulator according to claim 13 wherein said synthesized signal is coupled directly to the inputs of said first and second switching circuits.

15. A stereo signal demodulator according to claim 13 further comprising respective low pass filters coupling said first and second switching circuits to said first and second delay means.

16. A stereo signal demodulator according to claim 15 wherein said third switching circuit is coupled directly to said matrix circuit.

17. A stereo signal demodulator according to claim 13 including clock signal generator means coupled to said first and second delay means.

18. A stereo signal demodulator according to claim 13 wherein the inputs to said first switching means from said signal deriving circuit means are further coupled to said second delay means via respective ones of a first pair of delay means, and wherein the inputs to said second switching circuit from said signal deriving circuit means are coupled to said first delay means via respective ones of a second pair of delay means, the signals supplied to said first and second delay means via said pairs of delay means serving as clock signal sources therefor.

19. A stereo signal demodulator according to claim 13 wherein the inputs to said third switching circuit from said signal deriving circuit means are applied to said first and second delay means to serve as clock signal sources therefor.

20. A stereo signal demodulator according to claim 13 wherein said $n$-multiple frequency-multiplied signal is twice the frequency of said $m$-multiple frequency-multiplied signal.

21. A stereo signal demodulator according to claim 20 wherein said $m$-multiple frequency-multiplied signal is a 38 kHz signal, said phase-shifted $m$-multiple frequency-multiplied signal is a signal of frequency 38 kHz at an angle of $\pi/2$, and wherein said $n$-multiple frequency-multiplied signal is a signal of frequency 76 kHz.

22. A stereo signal demodulator according to claim 13 wherein said first and second delay lines each comprise a charge-coupled device.

23. A stereo signal demodulator according to claim 22 wherein each of said first and second delay lines comprises a plurality of capacitor stages coupled in series with each other, each of said stages including a storage capacitor and means for transferring a charge on said storage capacitor to the storage capacitor of the next successive stage, every other stage being coupled to a first clock pulse terminal and every other remaining stage being coupled to a second clock pulse terminal, whereby successive clock pulses applied to said first and second terminals cause transfer of said charge from the capacitor of one stage to the capacitor of the next successive stage.

24. A stereo signal demodulator according to claim 23 further including a source of first and second clock pulses which are respectively coupled to said first and second clock pule terminals of said respective first and second delay means, said clock pulses being out of phase with each other by 180°.

25. A stereo signal demodulator for a receiver in a four-channel stereo system in which four sound source signals (LF, LB, RF and RB) are transmitted from one station, the transmission being carried out for a synthesized signal comprising a signal in a main channel of (LF+LB)+(RF+RB), a pilot signal, a signal in a first sub-channel comprising a double side-band signal obtained by modulating an $m$-multiple frequency-multiplied signal of the pilot signal with a signal of (LF +

LB) − (RF + RB), a signal in a second sub-channel comprising a double side-band signal obtained by moulating the same $m$-multiple frequency-multiplied but phase-shifted signal with a signal of (LF − LB) + (RF − RB), and a signal in a third sub-channel comprising a signal obtained by modulating an $n$-multiple ($m<n$) frequency-multiplied signal of the pilot signal with a signal of (LF − LB) − (RF − RB);

the four-channel stereo signal demodulator comprising:

signal deriving circuit means including means for deriving from the pilot signal in said synthesized signal that has been FM-detected by a tuner an $m$-multiple frequency-multiplied signal of said pilot signal, a signal obtained by phase-shifting said $m$-multiple frequency-multiplied signal, and an $n$-multiple frequency-multiplied signal of said pilot signal;

first, second and third switching circuits for switching their input signals comprised of said synthesized signal, respectively, under control of the respective three outputs of said signal deriving circuit means to demodulate the signals in said respective channels from said synthesized signal;

a matrix circuit having the outputs of said three switching circuits applied to its inputs for separating and emitting at its output the signals LF, LB, RF and RB;

a filter and a phase-compensator circuit coupling said synthesized signal to the input of said third switching circuit; and first and second delay means coupling the outputs of said first and second switching circuits to the inputs of said matrix circuit.

26. A stereo signal demodulator according to claim 25 wherein the inputs to said first switching means from said signal deriving circuit means are further coupled to said second delay means via respective ones of a first pair of delay means, and wherein the inputs to said second switching circuit from said signal deriving circuit means are coupled to said first delay means via respective ones of a second pair of delay means, the signals supplied to said first and second delay means via said pairs of delay means serving as clock signal sources therefor.

27. A stereo signal demodulator according to claim 25 wherein said $n$-multiple frequency-multiplied signal is twice the frequency of said $m$-multiple frequency-multiplied signal.

28. A stereo signal demodulator according to claim 27 wherein said $m$-multiple frequency-multiplied signal is a 38 kHz signal, said phase-shifted $m$-multiple frequency-multiplied signal is a signal of frequency 38 kHz at an angle of $\pi/2$, and wherein said $n$-multiple frequency-multiplied signal is a signal of frequency 76 kHz.

29. A stereo signal demodulator according to claim 25 wherein said first and second delay lines each comprise a charge-coupled device.

30. A stereo signal demodulator according to claim 29 wherein each of said first and second delay lines comprises a plurality of capacitor stages coupled in series with each other, each of said stages including a storage capacitor and means for transferring a charge on said storage capacitor to the storage capacitor of the next successive stage, every other stage being coupled to a first clock pulse terminal and every other remaining stage being coupled to a second clock pulse terminal, whereby successive clock pulses applied to said first and second terminals cause transfer of said charge from the capacitor of one stage to the capacitor of the next successive stage.

31. A stereo signal demodulator according to claim 30 further including a source of first and second clock pulses which are respectively coupled to said first and second clock pulse terminals of said respective first and second delay means, said clock pulses being out of phase with each other by 180°.

* * * * *